US006398592B1

(12) United States Patent
Mori et al.

(10) Patent No.: US 6,398,592 B1
(45) Date of Patent: Jun. 4, 2002

(54) BUTT TYPE CONTACT TERMINAL AND CONNECTOR EMPLOYING THE SAME

(75) Inventors: Shigeo Mori; Kazuhisa Ishizaki, both of Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/712,917

(22) Filed: Nov. 16, 2000

(30) Foreign Application Priority Data

Nov. 16, 1999 (JP) ..... 11-325283

(51) Int. Cl.[7] ..... H01R 13/24; H01R 13/28; H01R 25/00; H01R 11/22; H01R 13/11

(52) U.S. Cl. ..... 439/700; 439/289; 439/851

(58) Field of Search ..... 439/700, 289, 439/843, 851

(56) References Cited

U.S. PATENT DOCUMENTS

| | | | | |
|---|---|---|---|---|
| 4,255,010 A | * | 3/1981 | Jullien | 339/176 |
| 4,591,222 A | | 5/1986 | Shaffer | 339/74 R |
| 4,703,986 A | * | 11/1987 | McCormick | 439/607 |
| 4,707,044 A | * | 11/1987 | Burns | 339/48 |
| 4,904,213 A | | 2/1990 | Hock et al. | 439/824 |
| 5,154,628 A | * | 10/1992 | Skegin | 439/336 |
| 5,486,123 A | * | 1/1996 | Miyazaki | 439/825 |
| 5,516,310 A | * | 5/1996 | Sawada | 439/843 |
| 5,556,292 A | * | 9/1996 | Kato et al. | 439/218 |
| 5,653,615 A | * | 8/1997 | Inaba et al. | 439/827 |
| 5,775,960 A | * | 7/1998 | Saito et al. | 439/843 |
| 5,897,404 A | * | 4/1999 | Goodman et al. | 439/843 |
| 5,921,822 A | * | 7/1999 | Kennedy et al. | 439/851 |
| 6,042,432 A | * | 3/2000 | Hashizawa | 439/843 |
| 6,159,056 A | * | 12/2000 | Boyle | 439/700 |

FOREIGN PATENT DOCUMENTS

| | | | |
|---|---|---|---|
| DE | 41 00 696 C1 | 3/1992 | H02G/15/02 |
| EP | 0 435 408 A2 | 7/1991 | H01H/1/14 |
| GB | 1 217 307 | 12/1970 | H01R/13/24 |
| JP | 59-7570 | 1/1984 | H01R/13/17 |
| JP | 59-7571 | 1/1984 | H01R/13/17 |
| JP | 6-50260 | 7/1994 | H01R/13/24 |

* cited by examiner

*Primary Examiner*—P. Austin Bradley
*Assistant Examiner*—Edwin A. León
(74) *Attorney, Agent, or Firm*—Sughrue Mion, PLLC

(57) ABSTRACT

A butt type contact terminal comprises a terminal body 3, a sliding contact member 4 slidably engaged around an outer periphery of the terminal body, and a resilient member 5 resiliently provided between the terminal body 3 and the sliding contact member 4, either one of the terminal body and the sliding contact member being provided with a plurality of elastic contact pieces 10 arranged in a circumferential direction by way of axial slits 9, and the terminal body and the sliding contact member being respectively provided with projections 11, 19 for engagement and contact therebetween. The terminal body 3 includes an elastic contact portion 6 in a cylindrical shape, a flange portion 8, and an electric wire connecting portion 7. The sliding contact member 4 includes a peripheral wall 15 in a cylindrical shape having the projections 19, a covering wall 16, and a contact portion 17. An outer diameter of the elastic contact portion 6 is larger than an inner diameter of the peripheral wall 15, whereby the elastic contact portion is elastically brought into contact with the peripheral wall. A coil spring 5 is resiliently provided between the peripheral wall 15 of the sliding contact member 4 and the flange portion 8 of the terminal body 3. The terminals 1 are inserted into a connector housing 23, the flange portions 8 are locked by locking lances 28, and waterproof packings are tightly fitted to the contact portions 17 and to the electric wires 2.

13 Claims, 5 Drawing Sheets

BUTT TYPE CONTACT TERMINAL AND CONNECTOR EMPLOYING THE SAME

BACKGROUND OF INVENTION

1. Field of Invention

The present invention relates to a butt type contact terminal employed in a power supplying connector in an electric car, for example, and having a structure in which a sliding contact member is adapted to slide by way of a coil spring when the connector is engaged or disengaged, and also to a connector employing the same.

2. Related Art

FIG. 6 shows a conventional butt type contact terminal.

This butt type contact terminal 61 is used in the power supplying connector of the electric car, for example, and includes a front end portion 62 and a rear end portion 63 made of conductive metal, a braided wire 64 for connecting the front end portion 62 to the rear end portion 63, and a coil spring 65 resiliently provided between the front end portion 62 and the rear end portion 63 for expanding the braided wire 64.

The braided wire 64 is press-fitted and connected to the front end portion 62 and the rear end portion 63. An electric wire 66 for power supply is connected to the rear end portion 63. When the power supplying connector (not shown) having the butt type contact terminal 61 is connected to the power receiving connector (not shown) in a vehicle, the front end portion 62 of the terminal 61 is abutted against a terminal of the power receiving connector to retreat against a biasing force of the oil spring 65, and at the same time, the braided wire 64 is contracted. Electric current flows from the electric wire 66 to a contact 62*a* at a forward end of the front end portion 62 by way of the braided wire 64, and from the contact 62*a* through the power receiving connector to be charged into a battery in the vehicle.

However, in the above described conventional butt type contact terminal 61 and the connector employing the same, the braided wire 64 is passed inside the coil spring 65, and the front end portion 62 and the rear end portion 63 must be press-fitted and connected to the braided wire 64 in a state where the coil spring 65 is contracted. Therefore, there have been such a problem that an annoying assembling work is required, thus, incurring a high cost.

In addition, because on each occasion of battery charging, (each time when the power supplying connector and the power receiving connector are engaged with and disengaged from each other), the braided wire 64 is expanded and contracted, it has been a problem that the braided wire 64 is apt to be cut, and electric resistance is increased resulting in a deterioration of electrical efficiency. Moreover, in case where the terminal and the connector are splashed with muddy salt water on occasion of the battery charging, it has been a problem that impurities such as mud or salt, etc. are adhered to the braided wire 64 to cause rust, and the electric resistance is increased resulting in a deterioration of the electrical efficiency. The muddy salt water generally occurs through freeze-proof activity or so, on road, for example, in the winter season.

SUMMARY OF INVENTION

In view of the above described problems, it is an object of the invention to provide a butt type contact terminal and a connector employing the same which will not increase electric resistance after repeated contacts with a mating connector, can always maintain favorable electric efficiency, can be easily assembled and manufactured at a low cost, and will not be affected by muddy salt water even though they are splashed with the muddy salt water.

In order to attain the above described object, the invention employs a butt type contact terminal characterized in that it comprises a terminal body connected to an electric wire, a sliding contact member slidably engaged around an outer periphery of the terminal body and having a contact portion with respect to a mating terminal at its forward end, and a resilient member resiliently provided between the terminal body and the sliding contact member, either one of the terminal body and the sliding contact member being provided with a plurality of elastic contact pieces arranged in a circumferential direction by way of axial slits, and a forward end of the terminal body and a rearward end of the sliding contact member being respectively provided with projections for engagement and contact therebetween.

It is also effective that the terminal body includes an elastic contact portion in a substantially cylindrical shape having a plurality of the elastic contact pieces, a flange portion extending from the elastic contact portion, and an electric wire connecting portion extending from the flange portion.

It is also effective that the sliding contact member includes a peripheral wall in a substantially cylindrical shape having the projections inwardly, a covering wall formed at a front end of the peripheral wall, and the contact portion provided on the covering wall so as to project therefrom.

Further, it is also effective that an outer diameter of the elastic contact portion in a free state is set to be larger than an inner diameter of the peripheral wall, whereby in a state where the elastic contact portion is inserted into the peripheral wall, the elastic contact portion is elastically brought into contact with an inner face of the peripheral wall.

Still further, it is also effective that the resilient member includes a coil spring which is resiliently provided between a rear end of the peripheral wall of the sliding contact member and the flange portion of the terminal body.

In addition, the invention also employs a connector employing the butt type contact terminal wherein at least one of the butt type contact terminals according to the present invention is inserted into a connector housing, the flange portion is locked by locking lances formed in the connector housing, and a waterproof packing is tightly fitted to the contact portion and to the electric wire.

DETAILED DESCRIPTION OF PREFERRED EMBODIMENTS

Figure 1:
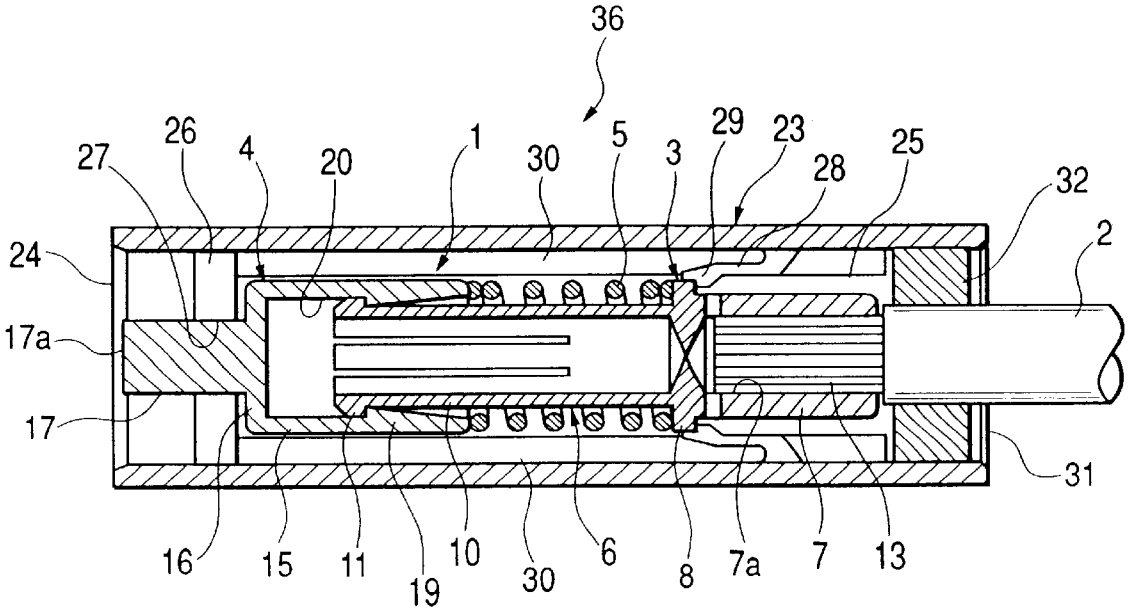
FIG. 1 is a longitudinally sectional view showing one embodiment of a butt type contact terminal and a connector employing the same according to the invention.

Now, an embodiment of the invention will be described in detail, referring to the drawings.

FIG. 1 shows one embodiment of the butt type contact terminal and the connector employing the same according to the invention.

This butt type contact terminal 1 consists of three components, namely, a terminal body 3 to be connected to an electric wire 2, a sliding contact member 4 engaged around an outer periphery of the terminal body 3 so as to be slidable back and forth, a coil spring (a resilient member) 5 resiliently provided between the terminal body 3 and the sliding contact member 4, which can be separated.

Figure 2:
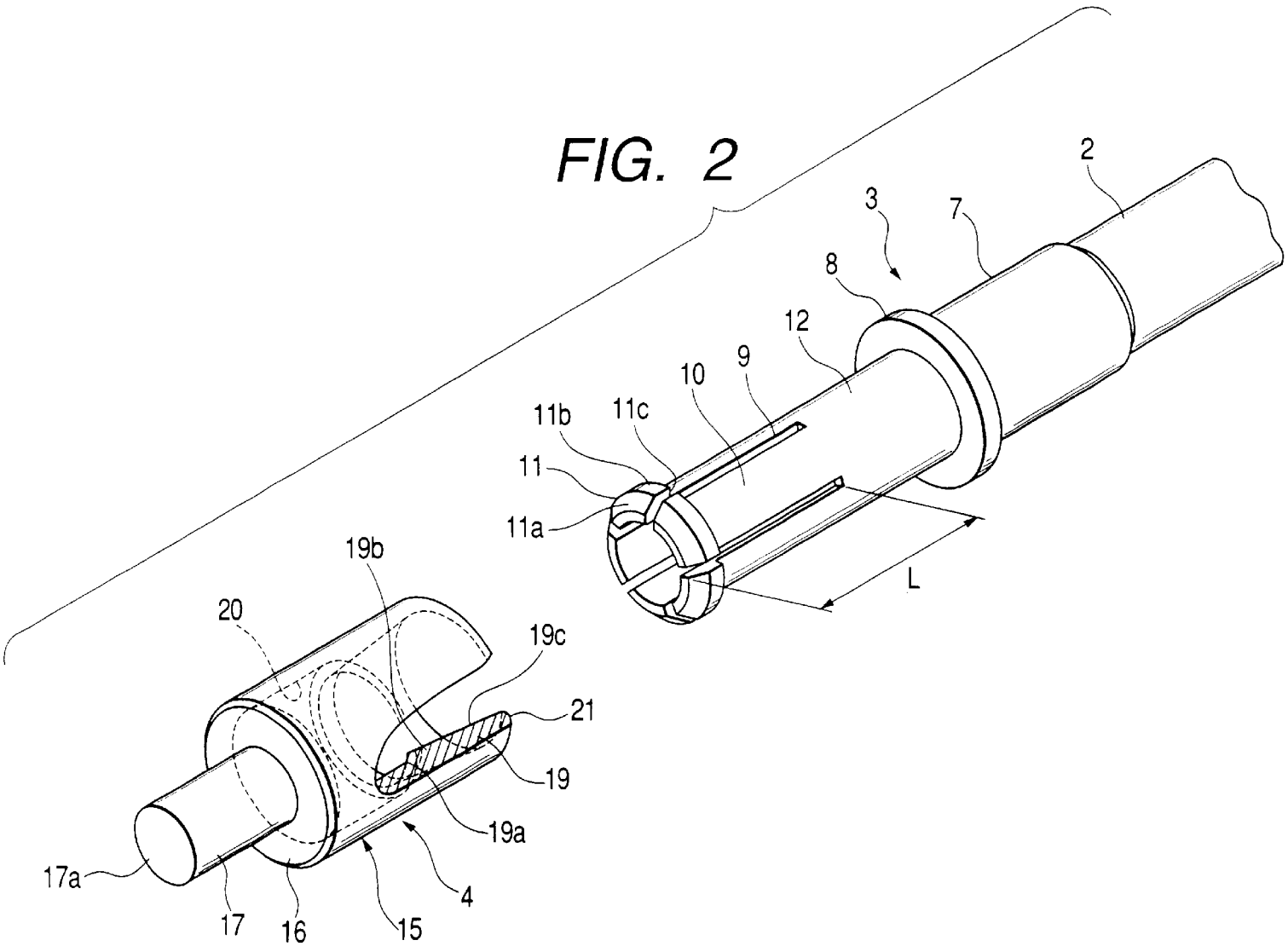
FIG. 2 is an exploded perspective view of the embodiment of the butt type contact terminal without a coil spring.

The terminal body 3 is formed of conductive metallic material and consists of a substantially cylindrical elastic contact portion 6 in a forward half, a substantially cylindrical electric wire press-fitting portion 7 in a backward half, and an intermediate flange portion 8 as shown in FIG. 2.

The elastic contact portion 6 has a plurality of elastic contact pieces 10 formed between a plurality of slits 9 (FIG. 2), and consists of the elastic contact pieces 10 and a cylindrical portion 12 (FIG. 2) at a base side. The elastic contact pieces 10 are equidistantly arranged on a circumference having an outer peripheral face and an inner peripheral face which are arcuate in a sectional view. Outside distal ends of the elastic contact pieces 10, are integrally formed projections (projected portions) 11 for engaging and contacting purposes. Each of the projections 11 includes a slanted face 11a (FIG. 2) at a front side, a contact face 11*b* at an outermost periphery, and an engaging face 11*c* at a back side. The elastic contact pieces 10 are flexible in a direction of their thickness (in a radial direction).

Length L and number of the slits 9 (FIG. 2) are appropriately determined according to contact load (contact pressure) of the elastic contact portion 6 with respect the sliding contact member 4. If the length L of the slit 9 is shortened, or the number of the slits 9 is reduced, the contact load will be increased, but the sliding resistance will be also increased. The length L and the number of the slits 9 are determined according to such balance. A width of the slit 9 is set in such a width that when the elastic contact portion 6 is inserted into the sliding contact member 4, the projections can be smoothly inserted without any obstacle.

The electric wire press-fitting portion 7 is integrally connected to the base side of the elastic contact portion 6 by way of the annular flange portion 8. The electric wire press-fitting portion 7 is in a cylindrical shape, and in a state where a conductive portion 13 at a distal end of the electric wire 2 (FIG. 1) is inserted into a bore 7*a,* caulked in a polygonal shape from outside by means of a press-fitting machine which is not shown. It is optional whether the sliding contact member 4 should be jointed with the terminal body 3 after the electric wire 2 has been press-fitted, or the sliding contact member 4 should be jointed with the terminal body 3 before the electric wire 2 is press-fitted.

The sliding contact member 4 is formed of conductive metallic material, and as shown in FIG. 2, consists of a peripheral wall 15 to be contacted with the terminal body 3, a covering wall 16 formed at a front end of the peripheral wall 15, and a cylindrical contact portion 17 which is integrally formed with the covering wall 16 so as to project forward therefrom.

The peripheral wall 15 is formed in an annular shape. A forward half of the peripheral wall 15 is formed straight having a constant thickness, and on an inner face of a backward half of the peripheral wall 15, is formed projected portions (projections) 19 which can engage with the projections 11 of the elastic contact pieces 10 of the terminal body 3 and are adapted to contact with outer peripheral faces of the elastic contact pieces 10. The projected portions 19 may be annularly formed along the entire circumference or may be partially arranged on the circumference in a form of projections.

An outer peripheral face and an inner peripheral face of the peripheral wall 15 are formed concentrically. Each of the projected portions 19 includes an engaging face 19*a* (FIG. 2) at a front side which is abutted against the engaging face 11*c* (FIG. 2) of the projection 11 of the aforesaid terminal body 3, an annular contact face 19*b* extending backward from the engaging face 19*a* in a straight line for a short distance, and a slanted face 19*c* enlarged in diameter in a tapered shape from the contact face 19*b* toward a rear end of the peripheral wall 15. The slanted face 19*c* acts as a guide face for the projection 11 of the terminal body 3 to be inserted. An inner diameter of the contact face 19*b* is smaller than an inner diameter of a large diameter portion 20 in the forward half of the peripheral wall 15. A rear end face 21 of the peripheral wall 15 acts as a seat face to be abutted against a front end face of the coil spring 5 (FIG. 1).

The coil spring 5 (FIG. 1) is mounted between the rear end face 21 of the sliding contact member 4 and a forward end face of the flange portion 8 in a rather contracted state. The forward end face of the flange portion 8 serves as a seat face with respect to the backward end face of the coil spring 5. The coil spring 5 is formed of conductive metallic material and electrically connects the sliding contact member 4 to the terminal body 3. Accordingly, even if a contact between the sliding contact member 4 and the terminal body 3 should become defective, a good electrical connection can be maintained. It is to be noted that the coil spring 5 can be formed of non-conductive material such as synthetic resin.

An inner diameter of the peripheral wall 15 is set so as to be rather smaller than an outer diameter of the elastic contact portion 6 in the free state. In other words, the inner diameter of the peripheral wall 15 at an area of the large diameter portion 20 is set to be rather smaller than outer diameters of the projections 11 of the elastic contact pieces 10. Alternatively, inner diameters of the projected portions 19 are set to be rather smaller than the outer diameter of the elastic contact portion 6.

This enables the elastic contact pieces 10 to be brought into contact with the inner face of the peripheral wall 15 in a state where they are biased outward, and a reliable electric contact can be performed with an appropriate contact pressure. Because the peripheral wall 15 and the elastic contact pieces 10 slidably contact with each other without any clearance, in case where muddy salt water should have intruded into the terminal 1, mud and salt will be scraped by the sliding contact between the peripheral wall 15 and the elastic contact pieces 10. Thus, a clean contact face can be always assured, an increase of the resistance will be prevented, and a favorable electric contact will be performed.

It is optional whether the outer peripheral faces 11*b* of the projections 11 of the terminal body 3 are contacted with the inner peripheral face of the large diameter portion 20 of the sliding contact member 4, or the inner peripheral faces 19*b* of the projected portions 19 of the sliding contact member 4 are contacted with the outer peripheral faces of the elastic contact pieces 10 of the terminal body 3, or alternatively, the outer peripheral faces 11*b* of the projections 11 of the terminal body 3 are contacted with the inner peripheral face of the large diameter portion 20 of the sliding contact member 4, and at the same time, the inner peripheral faces 19*b* of the projected portions 19 of the sliding contact member 4 are contacted with the outer peripheral faces of the elastic contact pieces 10 of the terminal body 3. This can be determined depending on which of a projecting height of the projection 11 and a projecting height of the projected portion 19 should be higher, or should be the same.

The cylindrical contact portion 17 is concentrically formed with the peripheral wall 15, and provided at its forward end with a flat contact face 17*a* to be in contact with a mating terminal (not shown). As shown in FIG. 1, the contact face 17*a* is rather retracted inward from a front opening 24 of a connector housing 23 made of synthetic resin. The contact portion 17 is inserted into an opening 27 formed in a front partition wall 26 in a terminal containing chamber 25 of the connector housing 23.

Flexible locking lances 28 are formed in a backward end portion the connector housing 23 so as to project forward from the inner wall face of the connector housing 23. A backward end of the flange portion 8 of the terminal body 3 is locked by projections 29 formed at forward ends of the locking lances 28, thus preventing a backward removal of the terminal 1 attached with the electric wire. At least one pair of the locking lances 28 are positioned in upper and lower parts of the terminal containing chamber 25.

A guide wall 30 is provided in the terminal containing chamber 25 in a longitudinal direction along the outer face of the peripheral wall 15 of the sliding contact member 4 and the outer peripheral face of the flange portion 8 of the terminal body 3. A forward end of the guide wall 30 extends up to the front partition wall 26, while a backward end of the guide wall 30 extends up to a front end of a waterproof rubber plug (a waterproof packing) 32 in a rear opening 31. The waterproof rubber plug 32 is engaged in the rear opening 31 of the terminal containing chamber 25 as it contains the electric wire 2 attached with the terminal. An intrusion of water, dust or so through the rear opening 31 can be prevented by the waterproof rubber plug 32.

Figure 3:
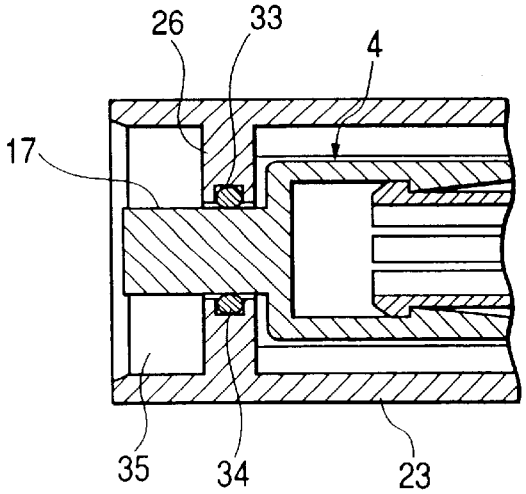
FIG. 3 is a longitudinally sectional view of an essential part showing the embodiment of a waterproofing structure in the connector employing the butt type contact terminal.

In the front opening 24 of the terminal containing chamber 25, an O-ring (the waterproof packing) 34 is fitted in a ring groove 33 formed at an inner diameter side of the partition wall 26 as shown in FIG. 3, for example. The outer peripheral face of the contact portion 17 of the sliding contact member 4 is slidably fitted in close contact to an inner peripheral face of the O-ring 34. It is also possible to eliminate the ring groove 34, and fit a waterproof packing (not shown) to be fixed into a space 35 in front of the partition wall 26, whereby the outer peripheral face of the contact portion 17 is slidably fitted in close contact to an inner peripheral face of the packing.

In FIG. 1, A connector 36 is constituted by the butt type contact terminal 1, the connector housing 23, the waterproof rubber plug 32, and the O-ring 34 in FIG. 3 or the waterproof packing which is not shown. The butt type contact terminal 1 to which the electric wire 2 is press-fitted is inserted into the terminal containing chamber 25 through the rear opening 31 of the connector housing 23, and the flange portion 8 is locked by the locking lances 28. The waterproof rubber plug 32 is previously mounted around the electric wire 2, and in that state, the butt type contact terminal 1 is press-fitted to the electric wire 2. After the insertion of the terminal, the waterproof rubber plug 32 is inserted through the rear opening 31.

Assembling of the butt type contact terminal 1 is easily conducted by inserting the substantially cylindrical elastic contact portion 6 of the terminal body 3 into the peripheral wall 15 of the sliding contact member 4 in a state where the coil spring 5 is mounted around the elastic contact portion 6. The projections 11 at the forward end of the elastic contact pieces 10 smoothly slide along the slanted faces 19c of the projected portions 19 inside the peripheral wall 15. Along with the sliding movement of the projections 11, the elastic contact pieces 10 are flexed inwardly, and at the instant that the projections 11 have entered into the large diameter portion 20 of the peripheral wall 15, the elastic contact pieces 10 elastically rebound outward, to bring the projections 11 into contact with the inner face of the peripheral wall 15, and/or to bring the projected portion 19 into contact with the outer peripheral faces of the elastic contact pieces 10 with an appropriate contact pressure.

Although the terminal body 3 is formed with the slits 9 in the described embodiment, as shown in FIG. 2, a plurality of slits (not shown) may be formed in the peripheral wall 15 of the sliding contact member 4 instead of the terminal body 3 to constitute a plurality of elastic contact pieces. In this case, the inner diameter of the peripheral wall 15 of the sliding contact member 4 is set to be rather smaller than the outer diameter of the cylindrical portion (corresponding to the numeral 6) of the terminal body 3. The peripheral wall 15 serves as the elastic contact portion. Between the sliding contact member 4 and the guide wall 30 of the connector housing 23 (FIG. 1), a small gap must be formed for the elastic contact pieces (not shown) of the peripheral wall 15 to be flexed.

Although the slanted faces 19*c* (FIG. 2) are formed in the inwardly projected portions 19 of the sliding contact member 4, it is also possible to eliminate the slanted faces 19*c* and to form projected portions (not shown) having straight inner peripheral faces to move along the outer peripheral faces of the elastic contact pieces 10 of the terminal body 3. In this case, an area of a rear end face (seat face) of each of the projected portions is increased thereby to stabilize the thrusting action against the coil spring 5 (FIG. 1) and the whole inner peripheral face of the projected portion 19 acts as the contact face thereby to increase a contact area with respect to the elastic contact piece 10.

By increasing windings of the coil spring 5 by one winding each at the forward end and the backward end of the coil spring 5 to form a doubly fitted shape, it is possible to increase the contact pressure of the contact portion 17 of the sliding contact member 4 with respect to the mating terminal (not shown). It is also possible to use a resilient member such as a rubber member or the like in place of the coil spring 5.

Figure 4:
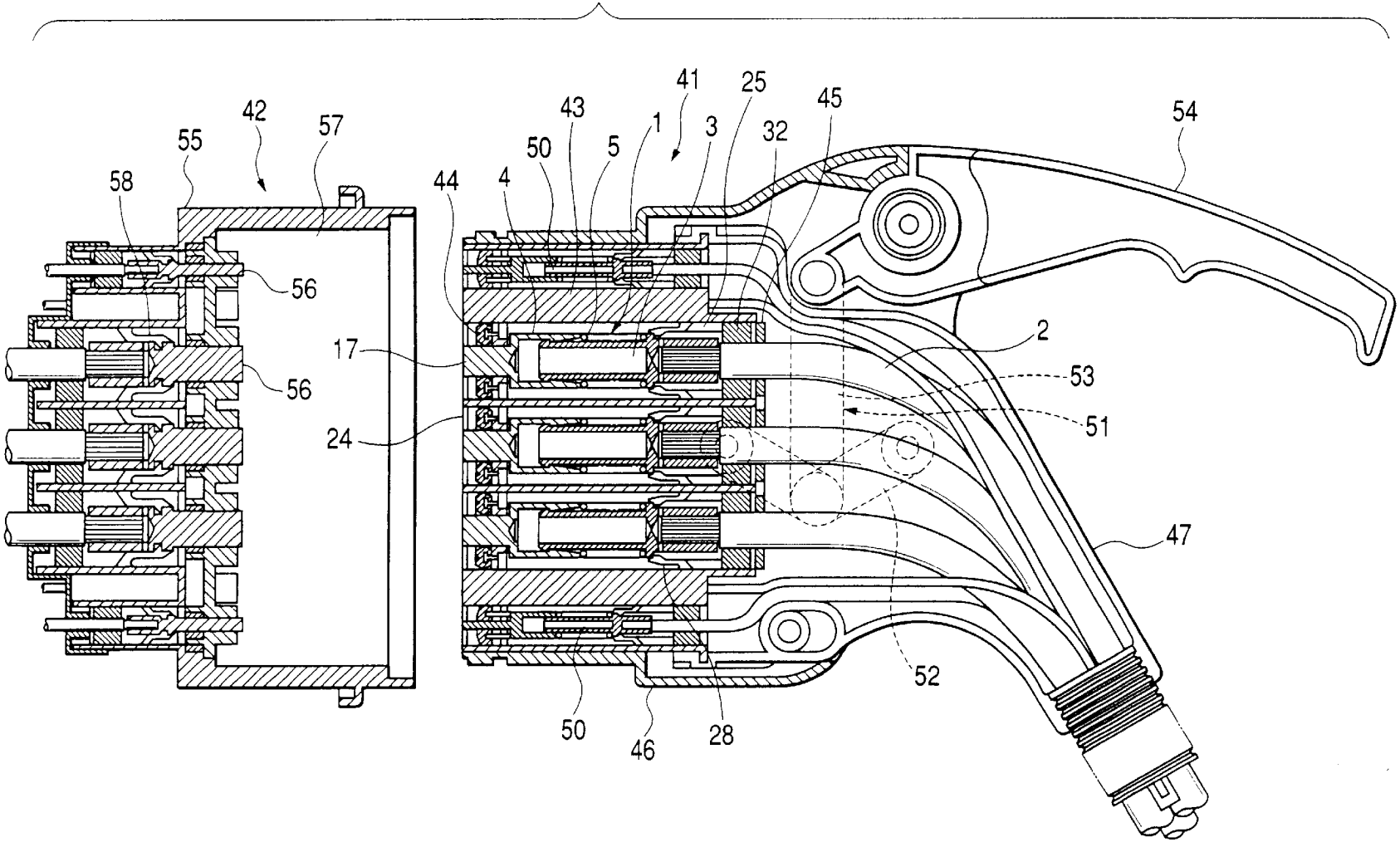
FIG. 4 is a longitudinally sectional view showing an example of application of the connectors employing the butt type contact terminals.
Figure 5:
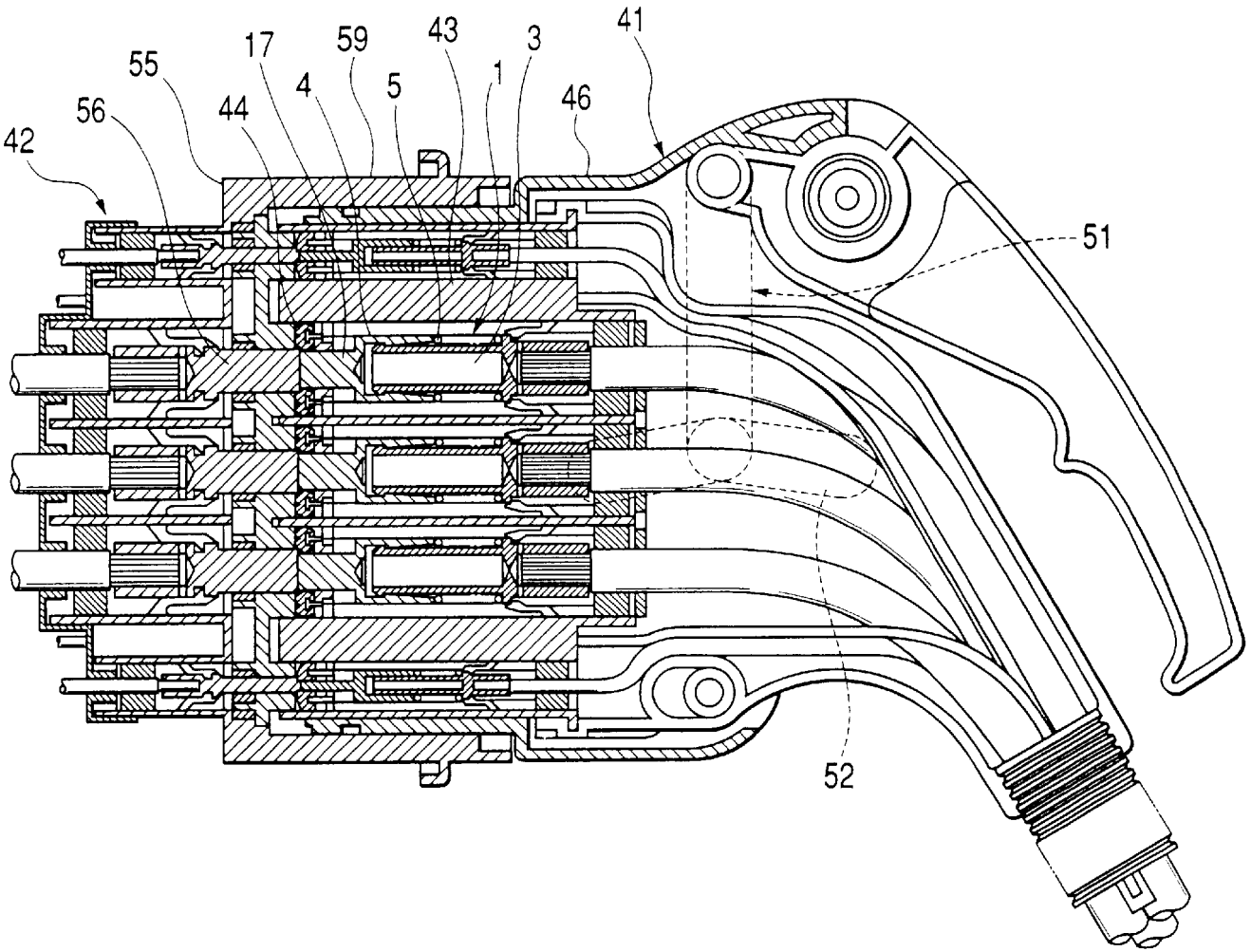
FIG. 5 is a longitudinally sectional view of the same showing the connectors in an engaged state.
Figure 6:
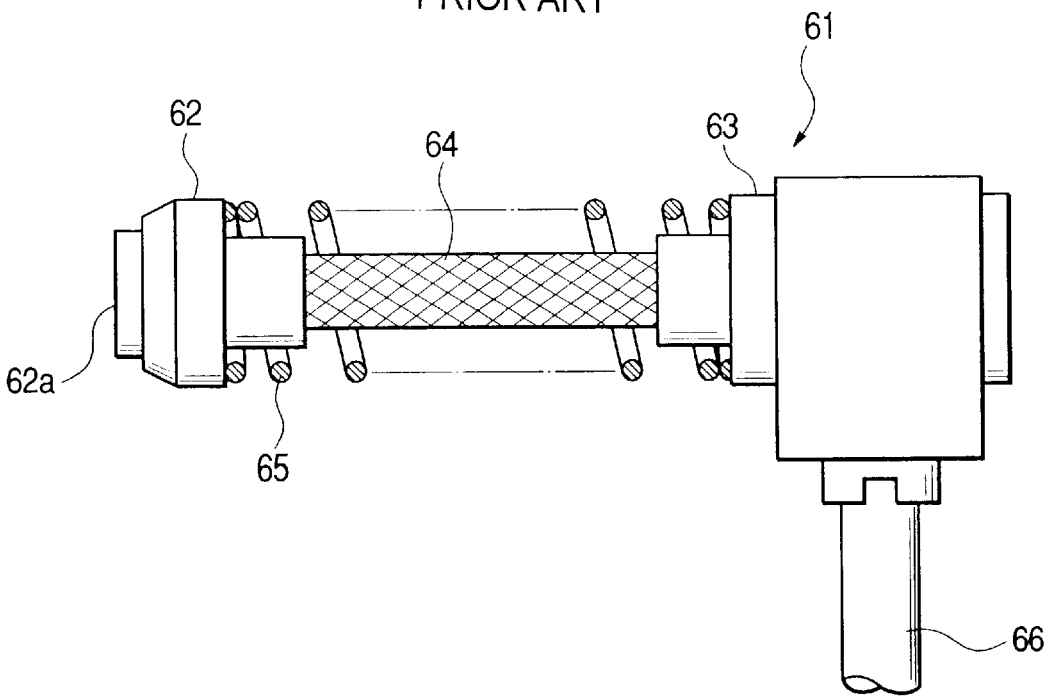
FIG. 6 PRIOR ART
FIG. 6 is a plan view showing a conventional example.

FIGS. 4 and 5 show an example in which the connector employing the above described butt type contact terminal is applied as a power supplying connector 41 for an electric car (including a hybrid car). A mating power receiving connector 42 has been already assembled to a vehicle. Same components as in the above described embodiment will be represented by the same reference numerals and a further explanation will be omitted.

As shown in FIG. 4, the power supplying connector 41 is provided with a plurality of the butt type contact terminals 1 (hereinafter referred to as the terminal 1) inside a connector housing 43 made of synthetic resin, front waterproof packings 44 and the rear waterproof rubber plugs (the waterproof packings) 32 arranged at an equal pitch in a radial manner for example. The waterproof rubber plugs 32 are retained by a rear holder 45 which is locked at a rear end of the connector housing 43 without extracting. The electric wires 2 press-fitted to the terminals 1 are guided out through a handle 47 in a rear of a casing 46 made of synthetic resin. The front waterproof packings 44 are fitted in the front openings 24 of the terminal containing chambers 25 and tightly fitted to the outer peripheries of the contact portions 17 of the sliding contact members 4.

On an outer periphery of the connector housing 43, are arranged small butt type contact terminal 50 for signal lines. Because a structure of this terminal 50 is the same as the aforesaid butt type contact terminal 1 for the power supply, though smaller, and has a similar functional effects, its explanation will be omitted.

The connector housing 43 is retained inside the casing 46 made of synthetic resin slidably in back and forth directions, and connected to respective one ends of a pair of sub links 52 of a toggle 51 which is a driving mechanism. A main link 53 of the toggle 51 is connected to an operating lever 54, and the operating lever 54 is pivotally supported on the casing 46. The toggle 51 is one example of the driving mechanisms, and it is apparent that another driving mechanism which is not shown can be employed.

The mating (on a vehicle side) power receiving connector 42 is provided with a plurality of the butt type contact terminals 56 inside a connector housing 55 corresponding to the aforesaid terminals 1. The connector housing 55 has a connector engaging chamber 57 in its forward half, and distal ends of the terminals 56 are rather projected into the engaging chamber 57. The terminals 56 are locked by flexible lances 58 inside the terminal containing chambers.

The power supplying connector 41 is engaged with the power receiving connector 42 from a state as shown in FIG. 4. By pulling downward the operating lever 54 of the power supplying connector 41, the connector housing 43 moves forward in the casing 46, and as shown in FIG. 5, the contact portions 17 of the sliding contact members 4 of the terminals I are abutted against the contact portions of the terminals 56 of the power receiving connector 42 to resiliently contact therewith by the biasing forces of the coil springs 5. On this occasion, the sliding contact members 4 of the terminals 1 retreat while contracting the coil springs 5.

The casing 46 of the power supplying connector 41 and connector engaging portions 59 in the front half of the connector housing 55 of the power receiving connector 42 are locked by locking means which are not shown. The connector housing 43 of the power supplying connector 41 is locked with the casing 46 by an upward rotation of the sub links 52 of the toggle 51.

After the battery charging has been finished, releasing the locking means which are not shown, the power supplying connector 41 is disengaged from the power receiving connector 42. On this occasion, the sliding contact members 4 move forward and are restored by the biasing forces of the coil springs 5.

When the power supplying connector 41 is engaged with and disengaged from the power receiving connector 42, an intrusion of rain water or so can be prevented by the front waterproof packings 44. If muddy salt water should have been adhered to the contact portions or so of the terminals 1, and mud and salt should have entered into the terminals 1 through wear of the front waterproof packings 44, the mud and salt will be scraped off by the sliding contact between the sliding contact members 4 and the terminal bodies 3 on occasion of engagement and disengagement of the connectors. Accordingly, the contact faces of the sliding contact members 4 and the terminal bodies 3 are always maintained in a favorable state (a state where contact resistance is small). This enhances reliability of the electrical connection.

As described above, according to the present invention, because the terminal body and the sliding contact member contact with each other by means of a plurality of the elastic contact pieces, a constant contact pressure can be maintained even with the repeated sliding contacts. Moreover, the resistance on the contact faces can be always kept low by the sliding contact, enabling a favorable electrical connection to be attained. There will be no fear that the braided wire may be damaged by the repeated engaging actions of the connectors as in the prior art. In case where muddy salt water or so should have intruded into the terminal, the mud and the salt will be scraped off by the elastic sliding contact between the terminal body and the sliding contact member, thus enabling good contact faces to be obtained. Especially, because the projected portions of the elastic contact pieces elastically and slidably contact with a counterpart, efficiency of the above described electrical contact and performance of scraping off the mud and the salt will be enhanced. In assembling the butt type contact terminal, since the terminal body is inserted into the sliding contact member in a state where the resilient member has been mounted on the terminal body, the elastic contact pieces are flexed, and accordingly, the terminal body can be easily inserted with a low inserting force. Further, since the sliding contact member can be engaged with the terminal body by means of the projections on both sides in a resiliently biased state, the cost can be saved because of the simple assembling work and the simple structure.

According to the present invention, because the elastic contact pieces formed in the terminal body are inwardly flexed on occasion of engaging with the sliding contact member and on occasion of the sliding contact therewith, an inner space is utilized and the structure can be made compact. In case where the elastic contact pieces are formed in the sliding contact member, the elastic contact pieces are flexed outwardly on occasion of engaging with the sliding contact member, and a space for flexing is required inside the terminal containing chamber in the connector housing.

According to the present invention, because the contact faces of the elastic contact pieces formed in the terminal body are contained inside the peripheral wall, the contact faces are protected from muddy salt water or dust from the exterior, thus enhancing reliability of the electrical connection between the terminal body and the sliding contact member. Moreover, because the projected portions of the peripheral wall slidably contact with the elastic contact pieces formed in the terminal body, a favorable contact pressure can be obtained, and the mud and the salt can be effectively scraped off.

According to the present invention, the contact pressure can be surely obtained by means of the elastic contact pieces, and at the same time, the mud and the salt can be effectively scraped off. Thus, the reliability of the electrical connection between the terminal body and the sliding contact member can be further enhanced.

According to the present invention, by employing the coil spring made of metal as the resilient member, the terminal body and the sliding contact member can be electrically connected by means of the coil spring thereby enhancing the reliability of the connection. Further, by directly biasing the rear end of the peripheral wall of the sliding contact member by means of the coil spring, the simple and compact structure can be realized.

According to the present invention, at the same time when the butt type contact terminals are inserted into the connector housing, the flange portions are locked by the locking lances to prevent backward removal of the butt type contact terminals. Moreover, the butt type contact terminals retreat together with the sliding contact member when their contact portions are pushed by the contact portions of the mating terminals on occasion of engagement of the connectors, and the contact portions slide along in tight contact with the front waterproof packings. Thus, the front waterproof packings assure waterproofing and dust proofing reliability of the contact portions, while the rear waterproof packings assure waterproofing and dust proofing reliability of the electric wires. Both the waterproof packings can prevent muddy salt water from intruding into the terminals.

What is claimed is:

1. A butt type contact terminal comprising:

a terminal body connected to an electric wire;

a sliding contact member slidably engaged around an outer periphery of said terminal body and having a contact portion with respect to a mating terminal at its forward end;

a resilient member resiliently provided between said terminal body and said sliding contact member;

a plurality of elastic contact pieces provided with one of said terminal body and said sliding contact member through axial slits in a circumferential direction, and projections for engagement and contact therebetween respectively provided with a forward end of said terminal body and a rearward end of said sliding contact member.

2. A butt type contact terminal as claimed in claim 1, wherein said terminal body includes an elastic contact portion in a substantially cylindrical shape having a plurality of said elastic contact pieces, a flange portion extending from said elastic contact portion, and an electric wire connecting portion extending from said flange portion.

3. A butt type contact terminal as claimed in claim 2, wherein an outer diameter of said elastic contact portion in a free state is set to be larger than an inner diameter of said peripheral wall, and wherein in a state where said elastic contact portion is inserted into said peripheral wall, said elastic contact portion is elastically brought into contact with an inner face of said peripheral wall.

4. A butt type contact terminal as claimed in claim 3, wherein said resilient member includes a coil spring which is resiliently provided between a rear end of said peripheral wall of said sliding contact member and said flange portion of said terminal body.

5. A butt type contact terminal as claimed in claim 2, wherein said sliding contact member includes a peripheral wall in a substantially cylindrical shape having said projections inwardly, a covering wall formed at a front end of said peripheral wall, and said contact portion provided on said covering wall so as to project therefrom.

6. A butt type contact terminal as claimed in claim 5, wherein said resilient member includes a coil spring which is resiliently provided between a rear end of said peripheral wall of said sliding contact member and said flange portion of said terminal body.

7. A butt type contact terminal as claimed in claim 5, wherein an outer diameter of said elastic contact portion in a free state is set to be larger than an inner diameter of said peripheral wall, and wherein in a state where said elastic contact portion is inserted into said peripheral wall, said elastic contact portion is elastically brought into contact with an inner face of said peripheral wall.

8. A butt type contact terminal as claimed in claim 7, wherein said resilient member includes a coil spring which is resiliently provided between a rear end of said peripheral wall of said sliding contact member and said flange portion of said terminal body.

9. A butt type contact terminal as claimed in claim 1, wherein said sliding contact member includes a peripheral wall in a substantially cylindrical shape having said projections inwardly, a covering wall formed at a front end of said peripheral wall, and said contact portion provided on said covering wall so as to project therefrom.

10. A butt type contact terminal as claimed in claim 9, wherein said resilient member includes a coil spring which is resiliently provided between a rear end of said peripheral wall of said sliding contact member and said flange portion of said terminal body.

11. A butt type contact terminal as claimed in claim 9, wherein an outer diameter of said elastic contact portion in a free state is set to be larger than an inner diameter of said peripheral wall, and wherein in a state where said elastic contact portion is inserted into said peripheral wall, said elastic contact portion is elastically brought into contact with an inner face of said peripheral wall.

12. A butt type contact terminal as claimed in claim 11, wherein said resilient member includes a coil spring which is resiliently provided between a rear end of said peripheral wall of said sliding contact member and said flange portion of said terminal body.

13. A connector comprising:

a connector housing;

a butt type contact terminal inserted into said connector housing, said butt type contact terminal including:

a terminal body connected to an electric wire;

a sliding contact member slidably engaged around an outer periphery of said terminal body and having a contact portion with respect to a mating terminal at its forward end;

a resilient member resiliently provided between said terminal body and said sliding contact member;

a plurality of elastic contact pieces provided with one of said terminal body and said sliding contact member through axial slits in a circumferential direction;

projections for engagement and contact therebetween respectively provided with a forward end of said terminal body and a rearward end of said sliding contact member, wherein a flange portion is locked by locking lances formed in said connector housing; and a waterproof packing tightly fitted to said contact portion and to said electric wire.

* * * * *